US008251277B2

(12) United States Patent
Katchko et al.

(10) Patent No.: US 8,251,277 B2
(45) Date of Patent: Aug. 28, 2012

(54) THERMAL SLEEVE, METHOD FOR MANUFACTURING A THERMAL SLEEVE, AND COMBINATION CUP AND THERMAL SLEEVE

(75) Inventors: John E. Katchko, Rhinelander, WI (US); David Raymond Uitenbroek, Sun Prairie Way, WI (US)

(73) Assignee: Wausau Paper Mills, LLC, Mosiness, WI (US)

( * ) Notice: Subject to any disclaimer, the term of this patent is extended or adjusted under 35 U.S.C. 154(b) by 1977 days.

(21) Appl. No.: 11/107,340

(22) Filed: Apr. 15, 2005

(65) Prior Publication Data

US 2006/0231606 A1 Oct. 19, 2006

(51) Int. Cl.
*B65D 3/00* (2006.01)

(52) U.S. Cl. ..... 229/403; 229/400

(58) Field of Classification Search ..... 229/400, 229/403, 409; 383/110
See application file for complete search history.

(56) References Cited

U.S. PATENT DOCUMENTS

| | | | | |
|---|---|---|---|---|
| 2,941,661 | A | 6/1960 | Picard et al. | |
| 3,879,257 | A | 4/1975 | Gentile et al. | |
| 5,205,473 | A | 4/1993 | Coffin, Sr. | |
| 5,222,656 | A | 6/1993 | Carlson | |
| 5,385,260 | A * | 1/1995 | Gatcomb | 229/400 |
| 5,425,497 | A | 6/1995 | Sorensen | |
| 5,454,484 | A | 10/1995 | Chelossi | |
| D383,947 | S | 9/1997 | Schaefer | |
| 5,667,135 | A | 9/1997 | Schaefer | |
| 5,669,553 | A | 9/1997 | Smith | |
| 5,674,590 | A | 10/1997 | Anderson et al. | |
| 5,746,372 | A | 5/1998 | Spence | |
| 5,775,577 | A | 7/1998 | Titus | |
| 5,794,843 | A | 8/1998 | Sanchez | |
| 5,826,786 | A | 10/1998 | Dickert | |
| 5,842,633 | A | 12/1998 | Nurse | |
| 5,857,615 | A * | 1/1999 | Rose | 229/403 |
| 6,126,584 | A * | 10/2000 | Zadravetz | 493/109 |
| 6,152,363 | A | 11/2000 | Rule, Jr. | |
| 6,187,140 | B1 | 2/2001 | Anderson et al. | |
| 6,277,241 | B1 | 8/2001 | Merker et al. | |
| 6,277,454 | B1 | 8/2001 | Neale et al. | |
| 6,286,709 | B1 | 9/2001 | Hudson | |
| 6,286,754 | B1 | 9/2001 | Stier et al. | |
| 6,290,091 | B1 | 9/2001 | Bell | |
| 6,343,735 | B1 | 2/2002 | Cai | |
| 6,364,151 | B1 | 4/2002 | Gale | |
| 6,378,766 | B2 | 4/2002 | Sadlier | |
| 6,601,728 | B1 | 8/2003 | Newkirk et al. | |
| 2001/0008180 | A1 | 7/2001 | Anderson et al. | |
| 2003/0226882 | A1 | 12/2003 | Porchia et al. | |
| 2004/0112949 | A1 | 6/2004 | Hed et al. | |
| 2005/0029337 | A1 | 2/2005 | Van Handel | |

FOREIGN PATENT DOCUMENTS

| | | |
|---|---|---|
| EP | 0411 752 A | 2/1991 |
| WO | WO 89/01074 | 2/1989 |

* cited by examiner

*Primary Examiner* — Nathan J Newhouse
*Assistant Examiner* — Christopher Demeree
(74) *Attorney, Agent, or Firm* — Merchant & Gould, P.C.

(57) ABSTRACT

A thermal sleeve is provided according to the invention. The thermal sleeve can be provided as a cup sleeve for wrapping a cup and providing thermal insulation. The cup sleeve includes a creped paper product having a first end, a second end, a first cup opening, and a second cup opening, and an adhesive holding the first end and the second end together to form a wrap wherein the wrap is sized to enclose a cup. A method for manufacturing a cup sleeve is provided. A combination cup and cup sleeve is provided.

13 Claims, 1 Drawing Sheet

THERMAL SLEEVE, METHOD FOR MANUFACTURING A THERMAL SLEEVE, AND COMBINATION CUP AND THERMAL SLEEVE

FIELD OF THE INVENTION

The invention relates to a thermal sleeve, a method for manufacturing a thermal sleeve, and a combination cup and thermal sleeve. The thermal sleeve provides insulation to protect a user's hand when holding an article that is hot or cold. The thermal sleeve can be referred to as a cup sleeve when it is used to wrap a cup. The thermal sleeve includes a layer of a creped paper product to provide thermal insulation.

BACKGROUND OF THE INVENTION

Cup sleeves or cup holders are commonly used with disposable coffee cups so that the person holding the cup does not burn his or her fingers. Prior to the use of cup sleeves, multiple cups were often used to provide a desired level of thermal insulation. One advantage of using cup sleeves is the reduction of paper while achieving a desired level of protection from heat. Exemplary cup sleeves or cup holders are disclosed by U.S. Pat. No. 5,425,497 to Sorensen, U.S. Pat. No. 5,669,553 to Smith, U.S. Pat. No. 6,286,754 to Stier et al., U.S. Pat. No. 6,152,363 to Rule, Jr., U.S. Pat. No. 6,601,728 to Newkirk et al., U.S. Pat. No. 5,746,372 to Spence, U.S. Pat. No. 5,842,633 to Nurse, U.S. Pat. No. 5,667,135 to Schaefer, U.S. Pat. No. 5,454,484 to Chelossi, and U.S. Pat. No. 5,222,656 to Carlson.

SUMMARY OF THE INVENTION

Figure 1:
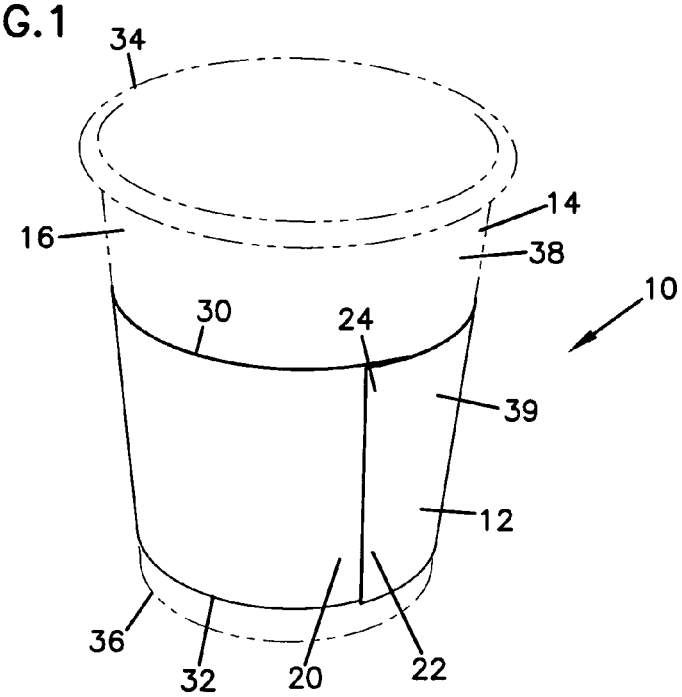
FIG. 1 is a perspective view of a single use cup and a cup sleeve according to the principles of the present invention.

A cup sleeve is provided according to the invention. The cup sleeve includes a creped paper product having a first end, a second end, a first cup opening, and a second cup opening, and an adhesive holding the first end and the second end together to form a wrap wherein the wrap is sized to enclose a cup.

A cup sleeve provided in the form of a laminate is provided according to the invention. The laminate includes a creped paper product, and adhesive, and a paper substrate. The paper substrate can be a creped paper product, an embossed paper product, or a smooth paper product. Providing the paper substrate as creped or embossed can enhance the ease of holding onto the cup sleeve.

A thermal sleeve is provided according to the invention. The thermal sleeve includes a creped paper product having a first end and a second end, and adhesive holding the first end and the second end together to form a wrap. The creped paper product has a basis weight of about 20 lbs/3,000 $ft^2$ to about 150 lbs/3,000 $ft^2$, and about 8 to about 100 crepe lines per linear inch.

A combination cup and cup sleeve is provided according to the invention. The cup sleeve is provided wrapping the cup. The cup sleeve comprises a creped paper product having a first end and a second end, and adhesive holding the first end and the second end together to form a wrap sized to enclose the cup. The cup can be provided as a paperboard cup.

A method for manufacturing a cup sleeve is provided according to the invention. The method includes steps of creping a paper substrate having a basis weight of about 20 lbs/3,000 $ft^2$ to about 150 lbs/3,000 $ft^2$ to provide a creped paper product having about 8 to about 100 crepe lines per linear inch, cutting the creped paper product to a cup sleeve blank having a first end, a second end, a first cup opening, and a second cup opening, and adhering the first end and the second end to form a wrap sized to enclose a cup.

DETAILED DESCRIPTION OF THE INVENTION

A thermal sleeve can be used with an article to provide thermal insulation between the article and the person's hand holding the article. Whether the article is hot or cold, the thermal sleeve can help reduce discomfort that may occur in the absence of the thermal sleeve, and may help hot articles remain hot and cold articles remain cold. The thermal sleeve can be used with a hot article such as a cup containing a hot beverage. The thermal sleeve, when used with a cup, can be referred to as a cup sleeve. Exemplary hot beverages that are commonly found in cups include coffee, tea, or cocoa. In general, the reference to coffee, tea, or cocoa refers to beverages that contain coffee, tea, or cocoa. Exemplary products that contain coffee include cafe au lait, latte, mocha, etc. Exemplary cold articles that can benefit from the use of the thermal sleeve include cups containing a cold beverage, ice cream cones, and ice cream cups.

When the thermal sleeve is intended to be used with a cup, it can be referred to as a cup sleeve. Cups that are intended to be discarded after use can be referred to as single use cups. The cup sleeve can be discarded along with the single use cup. Single use cups that are manufactured from paperboard can be referred to as paperboard cups. The paperboard cups can be polymer coated, wax coated, or non-coated. Single use cups can include foam cups. Other single use cups such as those formed from a smooth material can be referred to as plastic cups and often fail to provide a desired level of thermal insulation without the need of a cup sleeve to provide additional thermal insulation. A cup sleeve can be used with any type of single use cup including paperboard cups, plastic cups, and foam cups.

Now referring to FIG. 1, a thermal sleeve provided in the form of a cup sleeve is shown at reference number 10. The cup sleeve 10 is shown as a wrap 12 enclosing a single use cup 14. The single use cup 14 can be provided as a paperboard cup 16 that is commonly used to hold a hot beverage such as coffee, tea or cocoa.

The cup sleeve includes a first end 20 and a second end 22. The first end 20 and the second end 22 refer to general areas of the cup sleeve 12 rather than the edges. The first end 20 and the second end 22 can be adhered together at an area of overlap 24 using an adhesive (not shown). The adhesive can be any adhesive capable of providing a paper-to-paper bond. Exemplary adhesives that can be used to bond the first end 20 and the second end 22 together include pressure sensitive adhesives, hot melt adhesives, contact adhesives, extruded polymer curing, and drying adhesives.

The cup sleeve 10 includes a first cup opening 30 and a second cup opening 32. The first cup opening 30 can have a circumference that is greater than the circumference of the second cup opening 32. In general, by providing a circumference of the first cup opening 30 that is greater than the circumference of the second cup opening 32, the cup sleeve can be provided having a conical shape. A conical shape allows the cup sleeve 10 to more closely fit the structure of many single use cups that are tapered from the cup opening 34 to the cup base 36. The cup taper can be provided to facilitate stacking or nesting of multiple single use cups. The conical shape of the cup sleeve 10 additionally helps reduce the possibility of the cup 14 sliding through the cup sleeve 10. The conical shape can be referred to as a taper.

The cup sleeve 10 can have a length from the first cup opening 30 to the second cup opening 32 that is sufficient to allow someone to grip the cup sleeve 10 to support the cup 14 filled with a liquid. It may be desirable for the length to be sufficient so that the user need not touch the cup 14 when holding the cup sleeve 10. By way of example, the length can be about 2 inches to about 4 inches. The diameter of the cup sleeve 10 can be selected so that the cup sleeve 10 wraps the cup 12. For example, in the case of many cups intended for use in holding coffee, the cup sleeve can have a diameter of about 2 inches to about 4 inches.

Figure 2:
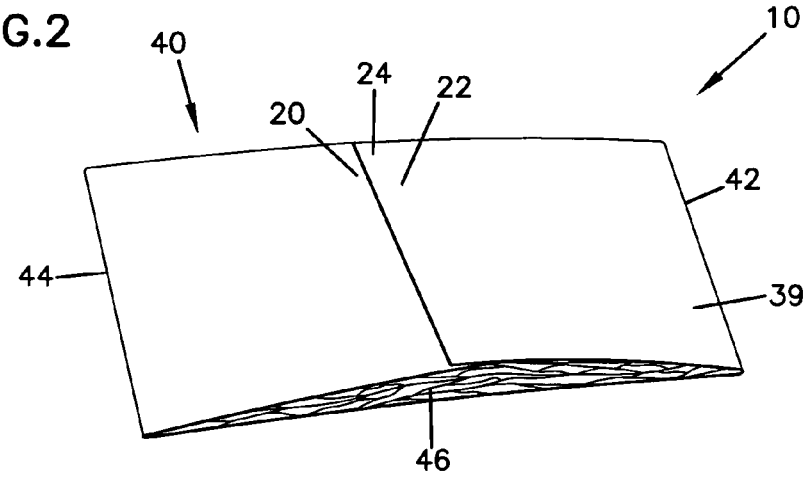
FIG. 2 is a perspective view of the cup sleeve of FIG. 1 provided in a folded or flattened configuration.

Now referring to FIG. 2, the cup sleeve 10 is shown in a folded or flattened configuration 40. The cup sleeve 10 can be flattened as a result of fold lines 42 and 44. The cup sleeve 10 can be manufactured by folding a cup sleeve blank 46 along fold lines 42 and 44 and adhering the first end 20 and the second end 22 together along the area of overlap 24.

A plurality of cup sleeves can be packaged in the flattened configuration 40. One advantage of providing the cup sleeve 10 in a flattened configuration is that many cup sleeves can be packaged together for transportation. The thickness of the cup sleeve 10 refers to the distance t shown in FIG. 3. This distance generally reflects the distance between the cup outer surface 38 and the cup sleeve outer surface 39. The thickness t can be less than the thickness of many commonly used corrugated type cup sleeves while providing a desired level of thermal insulation. As a result, several more cup sleeves 10 can be packaged in a fixed size container compared with thicker corrugated type sleeves.

The cup sleeve 10 can include a creped paper product so that the cup sleeve 10 provides a desired level of thermal insulation properties. The creped paper product can be obtained by subjecting a paper substrate to a creping technique or process. In general, a creping technique involves impacting the paper substrate to create crinkles or crepe lines. The creped paper product can be referred to more simply as the "creped paper."

The cup sleeve 10 can include a single layer of creped paper or a laminate containing a layer of creped paper and a substrate. The substrate can be any substrate that adheres to the creped paper and provides a desired laminate. Exemplary substrates include creped paper, embossed paper, or smooth paper. When the substrate includes creped paper, the laminate can be a laminate of creped paper and creped paper. The creped paper layers can be the same or different. Embossed paper refers to a paper substrate that has been subjected to an embossing technique or process to create inundations. Providing the substrate as creped paper or embossed paper can be advantageous when it is desirable to provide the cup outer surface with a roughness than enhances friction so that it becomes easier to hold onto the surface. Smooth paper refers to paper that has not been creped or embossed. Smooth paper may be advantageous when it is desirable to provide the cup sleeve 10 with an outer surface 39 having a smooth surface with printing thereon. In general, printing refers to the presence of words or other graphical representation that provides a desired appearance.

Figure 3:
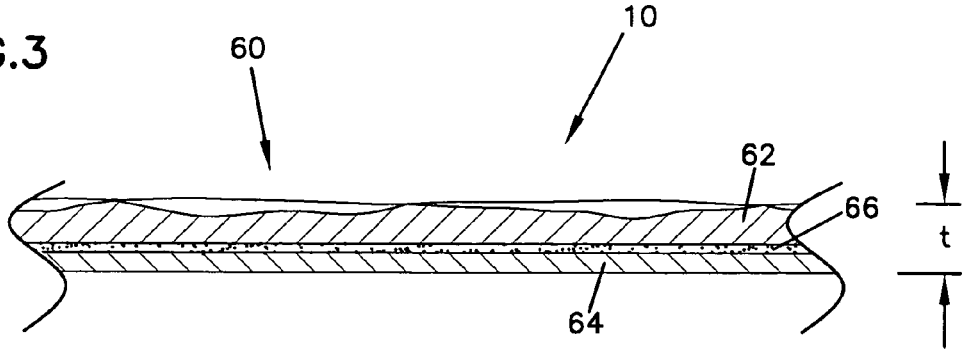
FIG. 3 is a sectional view of the cup sleeve (not to scale) of FIG. 1 showing a laminate structure.

The cup sleeve 10 shown in FIGS. 1-3 is a laminate 60 of creped paper 62 and smooth paper 64, wherein the creped paper 62 and the smooth paper 64 are held together by an adhesive 66. The smooth paper 64 can form the outer sleeve surface 39. It is the outer sleeve surface that is exposed for view when the cup sleeve wraps a cup. The outer sleeve surface can be available for providing desired printing thereon. An advantage of providing the cup sleeve as a laminate 60 is the ability to print on the smooth paper 64 and provide desired thermal insulation properties as a result of the creped paper 62. It should be appreciated, however, that one can print on the creped paper to provide an outer sleeve surface having a desired appearance and one can print on embossed paper to provide an outer sleeve surface having a desired appearance. An advantage of printing on smooth paper and having the smooth paper form the outer sleeve surface is that the quality of printing can be improved. Although one can print on creped paper and embossed paper and provide desired results, it is expected that printing on smooth paper can provide results that even more desirable. In addition, it should be understood that printing on creped paper may be more desirable than printing on corrugated paper that is often used in the formation of conventional cup sleeves.

The creped paper can refer to a single layer structure of a web of fibers that has been creped, or to a laminate containing at least one layer of a web of fibers that has been creped. In the case of a laminate, an additional layer can include, for example, smooth paper substrate that can include a surface having printing thereon. The printing can be provided as words or other graphics as desired. In addition, any of the layers of the laminate can be provided as kraft paper. In general, kraft paper refers to paper containing little or no additives or coatings. Kraft paper can be bleached or unbleached, and can be calendered or non-calendered. In addition, the paper used to form the substrates of the sleeve can be coated paper. The coated paper can have a coating of a wax or polymer material. Coated papers are well known in the art and are available for providing improved print quality or glossy or smooth appearance. In addition, the substrate can be formed from paper that may be considered non-kraft paper, and the non-kraft paper can be bleached or unbleached.

The phrase "machine direction" in reference to the paper product refers to the lengthwise (continuous) direction of the paper product as it is formed on a paper making machine. The machine direction can be referred to as the continuous direction and is the direction along which the paper product travels as it is manufactured. The phrase "cross direction" or "transverse direction" is the width, or direction perpendicular to the continuous direction, of the paper product. It should be understood that the paper product can be provided with any dimension, as desired. Techniques for creping are disclosed in U.S. application Ser. No. 11/080,346 that was filed with the United States Patent and Trademark Office on Mar. 15, 2005. The entire disclosure of U.S. application Ser. No. 11/080,346 is incorporated herein by reference.

The creping process results in the formation of crepe lines on the paper substrate. In general, it is desirable to provide the creped paper with a sufficient number of crepe lines per linear inch so that the cup sleeve possesses desired thermal insulation properties. The number of crepe lines per linear inch may vary depending upon the weight of the paper. It is generally more difficult to provide a high number of crepe lines per-linear inch in heavier papers compared with lighter papers. In general, heavier papers are often considered more abrasive and rougher compared with lighter papers that are considered finer and smoother. The weight of the paper, the number of crepe lines per linear inch, and the apparent density of the paper can be controlled to provide the cup sleeve with the desired insulation properties. In a creping process, the crepe lines can be formed along the cross or transverse direction.

The creped paper can be arranged so that the crepe lines run in any desired direction when the creped paper is formed as a cup sleeve. For the cup sleeve shown in FIG. 2, the crepe lines run in a direction that corresponds to a direction around the circumference of the cup 14. If desired, the cup sleeve can be arranged so that the crepe lines run from the top to the bottom of the cup or so that the crepe lines run in any desired direction of the crepe lines depends on the selection of the configuration and arrangement of the cup sleeve blank.

The basis weight of the paper can be selected to provide a desired level of thermal insulation. If the basis weight is too low, not enough thermal insulation will be achieved. If the basis weight is too high, it may be difficult to package a desirable number of cup sleeves in a single packaging unit. For example, the basis weight of the paper substrate prior to creping can be at least about 20 lb/100 $ft^2$. In addition, the basis weight of the paper substrate prior to creping can be less than about 150 lb/100 $ft^2$. The basis weight can be determined according to test method TAPPI T410.

The number of crepe lines per linear inch can be controlled to provide the desired roughness or inundation level to achieve a desired level of thermal insulation or friction. In general, if the number of crepe lines per linear inch is too low, the benefits of creping to increase thermal insulation may not be achieved. If the number of crepe lines per linear inch is too high, it may be difficult to manufacture the creped paper product. By way of example, it is expected that a creped paper product for use as a cup sleeve can have at least about 8 crepe lines per linear inch and can have less than about 100 crepe lines per linear inch. The number of crepe lines per linear inch can be determined by counting the hills of the creping across the sheet for one inch on the backside of the sheet. The backside of the sheet is the side opposite the side impacted to create the crepe lines.

The apparent density of a paper substrate depends on the thickness of the paper substrate and the basis weight of the paper substrate. In general, a flat sheet having a basis weight of about 20 lb/100 $ft^2$ to about 150 lb/100 $ft^2$ can be associated with an apparent density of about 0.7 $g/cm^3$ or higher. A flat sheet refers to a non-creped paper substrate. Creped paper prepared from paper having a basis weight of about 20 lb/100 $ft^2$ to about 150 lb/100 $ft^2$ for use in the cup sleeve can be provided having an apparent density of less than about 0.7 $g/cm^3$. The apparent density of the creped paper can be less than about 0.6 $g/cm^3$. The apparent density of the creped paper can be greater than about 0.05 $g/cm^3$. In addition, the apparent density of the creped paper can be about 0.1 $g/cm^3$ to about 0.5 $g/cm^3$, and can be about 0.2 $g/cm^3$ to about 0.4 $g/cm^3$. The apparent density can be calculated according to test methods TAPPI T41 caliper and T410 basis weight.

The creped paper can be laminated to a substrate that can be creped paper, embossed paper, or smooth paper. Smooth paper refers to any paper substrate that has not been creped or embossed and is available to receive printing or graphics and that can be bonded to the creped paper. Examples of the smooth paper include unbleached kraft paper and bleached kraft paper. The smooth paper can be calendered or non-calendered, and can be coated or non-coated. The basis weight of the smooth paper should be sufficient so that the paper can be processed through paper processing equipment so that it can be printed upon and bonded to the creped paper. For example, the basis weight of the smooth paper can be greater than about 16 lbs/3,000 $ft^2$ according to test method TAPPI T410. The basis weight of the smooth paper can be less than about 70 lbs/3,000 $ft^2$ according to test method TAPPI T410.

The paper substrate bonded to the creped paper to form the laminate can have a fiber strength that allows it to adhere to the creped paper, and can have a surface that allows it to receive printing when it is intended to be printed on to provide an outer surface that is available for viewing when the laminate is used. To provide a paper substrate that adheres sufficiently to the creped paper, the paper substrate can be selected to provide a wax pick value of greater than about 6 according to TAPPI T459. To provide a surface having desired print characteristics, the paper substrate can be selected to provide a parker print surface value of less than about 10 according to TAPPI T555.

The laminate can be formed by bonding the creped paper to creped paper, embossed paper, or smooth paper using an adhesive. The amount of adhesive depends upon the type of adhesive used and the degree of adhesion desired. In general, it is desirable to use a sufficient amount of adhesive to allow the laminate to remain as a laminate during use as a thermal sleeve. Exemplary adhesives include acrylic adhesives, acrylonitrile adhesives, aliphatic adhesives, casein glue adhesives, cellulose adhesives, contact cement adhesives, epoxy adhesives, latex based adhesives, hot melt adhesives, thermal or water curing adhesives, and polymer extrusion adhesives. The adhesives can be aqueous, solvent based, solventless, or extruded. The amount of adhesives used can be at a dry weight of about 0.25 lbs/3,000 $ft^2$ to about 50 lbs/3,000 $ft^2$ wherein the weight is determined according to test method TAPPI T410. The dry weight refers to the solids content of the adhesive where water or non-water solvent used in the adhesive is not part of the measured dry weight of the adhesive.

The paper substrate used to form the creped paper or the embossed paper can be any paper substrate that provides the desired properties of thermal insulation and allows for creping or embossing. In general, it may be desirable to form the paper substrate from materials that are as inexpensive as possible yet provide the desired thermal insulation properties. It is generally expected that the cup sleeve will be discarded after use.

Web of Fibers

The fibers used to form the paper substrate can be selected to provide the paper substrate with desired properties. One of skill in the art will appreciate that the web of fibers can comprise many different types of fibers, both natural and synthetic. Natural fibers from plants can often be referred to as cellulosic fibers. Exemplary natural fibers that can be used include wood fibers and non-wood natural fibers such as vegetable fibers, cotton, various straws (wheat, rye, and others), various canes (bagasse and kenaf), grasses (bamboo, etc.), hemp, corn stalks, etc.

The pulp used for creating the web of fibers can include hardwood fibers, softwood fibers, recycled fibers or a blend of hardwood fibers and softwood fibers and recycled fibers. The pulp can be provided as cellulose fiber from chemical pulped wood, and can include a blend from coniferous and deciduous trees. By way of example, the fibers can be from northern hardwood, northern softwood, southern hardwood, or southern softwood. Hardwood fibers tend to be more brittle but are generally more cost effective for use because the yield for pulp from hardwood is higher than the yield for pulp from softwood. The pulp can contain about 0 to about 100% hardwood fibers based on the weight of the fibers. Softwood fibers have desired paper making characteristics but are generally more expensive than hardwood fibers. The pulp can contain about 0 to about 100% softwood fibers based on the weight of the fibers. The pulp can contain a blend of hardwood and softwood fibers.

The natural fibers used in the invention can be extracted with various pulping techniques. For example, mechanical or high yield pulping can be used for stone ground wood, pressurized ground wood, refiner mechanical pulp, and thermomechanical pulp. Chemical pulping can be used incorporating kraft, sulfite, and soda processing. Semi-chemical and chemi-mechanical pulping can also be used which includes combinations of mechanical and chemical processes to produce chemi-thermomechanical pulp.

The fibers can also be bleached or unbleached. One of skill in the art will appreciate that the bleaching can be accomplished through many methods including the use of chlorine, hypochlorite, chlorine dioxide, oxygen, peroxide, ozone, or a caustic extraction.

The pulp can also include post-consumer waste (PCW) fiber. Post-consumer waste fiber is recovered from paper that is recycled after consumer use. Post-consumer waste fiber can include both natural and synthetic fiber. Incorporation of PCW fiber can aid in efficient use of resources and increase the satisfaction of the end user.

Refining is the treatment of pulp fibers to develop their papermaking properties. Refining increases the strength of fiber to fiber bonds by increasing the surface area of the fibers and making the fibers more pliable to conform around each other, which increases the bonding surface area and leads to a denser sheet, with fewer voids. Most strength properties of paper increase with pulp refining, since they rely on fiber to fiber bonding. The tear strength, which depends highly on the strength of the individual fibers, actually decreases with refining. Refining of pulp increases the fibers flexibility and leads to denser paper. This means bulk, opacity, and porosity decrease (densometer values increase) with refining. Fibrillation is a result of refining paper fibers. Fibrillation is the production of rough surfaces on fibers by mechanical and/or chemical action; refiners break the outer layer of fibers, i.e., the primary cell wall, causing the fibrils from the secondary cell wall to protrude from the fiber surfaces.

The thermal sleeve (e.g., cup sleeve) according to the invention can provide a number of advantages relative to the prior art. For example, the cup sleeve can be provided having a desired thermal insulating value while lighter in weight than many prior art cup sleeves. This increased lightness in weight reflects an ability to package more cup sleeves in a single container. In addition, the cup sleeve offers an ease of manufacture and an ability to be printed upon that is not available with certain types of cup sleeves.

It should be understood that the thermal sleeve can be used in environments other than as a wrap for a disposable cup. For example, the thermal sleeve can be used as a wrap for an ice cream cone (or cup) or some other relatively cold object, or as a wrap for some other relatively hot object. In addition, the blank can be configured to form a hot pad.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A cup sleeve comprising:

(a) a creped paper product having a first end, a second end, a first cup opening, and a second cup opening;

wherein the creped paper product comprises a laminate of creped paper adhered to smooth paper;

wherein the creped paper has about 8 to about 100 crepe lines per linear inch and a basis weight, prior to creping of about 20 lbs/3000 $ft^2$ to about 150 lbs/3000 $ft^2$ according to TAPPI T410;

the smooth paper has a basis weight of about 16 lbs/3000 $ft^2$ to about 80 lbs/3000 $ft^2$ according to TAPPI T410 and comprises printing thereon; and the smooth paper and the creped paper are adhered by an adhesive present at a dry weight of about 0.25 lbs/3000 $ft^2$ to about 50 lbs/3000 $ft^2$ according to TAPPI T410; and (b) adhesive holding the first end and the second end together to form a wrap sized to enclose a cup.

2. A cup sleeve according to claim 1, wherein the creped paper product has a height extending from the first cup opening to the second cup opening sufficient to allow a user to hold the wrap to provide thermal insulation between the user and the cup.

3. A cup sleeve according to claim 2, wherein the height from the first cup opening to the second cup opening is about 2 inches to about 4 inches.

4. A cup sleeve according to claim 1, wherein the first cup opening has a first circumference and the second cup opening has a second circumference, and the first circumference is greater than the second circumference to provide the cup sleeve with a tapered configuration.

5. A cup sleeve according to claim 4, wherein the cup sleeve has a configuration sufficient to conform to the shape of a paperboard cup.

6. A cup sleeve according to claim 1, wherein the creped paper product has an apparent density of less than about 0.7 $g/cm^3$ according to test methods TAPPI T41 caliper and T410 basis weight.

7. A cup sleeve according to claim 1, wherein the creped paper product has an apparent density of about 0.05 $g/cm^3$ to about 0.6 $g/cm^3$ according to test methods TAPPI T41 caliper and T410 basis weight.

8. A cup sleeve according to claim 1, wherein the cup sleeve has an inside surface constructed for contacting a cup, and an outside surface comprising the smooth paper.

9. A cup sleeve according to claim 8, wherein the smooth paper substrate comprises printing thereon.

10. A combination cup and cup sleeve comprising:

(a) a cup; and (b) a cup sleeve comprising:

(i) a creped paper product having a first end, a second end, a first cup opening, and a second cup opening;

wherein the creped paper product comprises a laminate of creped paper adhered to smooth paper;

wherein the creped paper has about 8 to about 100 crepe lines per linear inch and a basis weight, prior to creping of about 20 lbs/3000 $ft^2$ to about 150 lbs/3000 $ft^2$ according to TAPPI T410;

the smooth paper has a basis weight of about 16 lbs/3000 $ft^2$ to about 80 lbs/3000 $ft^2$ according to TAPPI T410 and comprises printing thereon; and the smooth paper and the creped paper are adhered by an adhesive present at a dry weight of about 0.25 lbs/3000 $ft^2$ to about 50 lbs/3000 $ft^2$ according to TAPPI T410; and (ii) adhesive holding the first end and the second end together to form a wrap sized to enclose a cup.

11. A combination cup and cup sleeve according to claim 10, wherein the cup comprises a paperboard cup.

12. A combination cup and cup sleeve according to claim 10, wherein the cup comprises a plastic cup.

13. A combination cup and cup sleeve according to claim 10, wherein the cup comprises a polymer coated paperboard cup.

* * * * *